US005938360A

United States Patent [19]

Yen et al.

[11] Patent Number: 5,938,360

[45] Date of Patent: Aug. 17, 1999

[54] PEN NIB STRUCTURE FOR SMOOTH PAINTING

[75] Inventors: Ming-Hua Yen, Taipei Hsien; Tro-Kung Ku, Tainan, both of Taiwan

[73] Assignee: Macide Enterprise Limited Company, Taipei Hsien, Taiwan

[21] Appl. No.: 08/893,661

[22] Filed: Jul. 11, 1997

[51] Int. Cl.[6] ..... B43K 5/00

[52] U.S. Cl. ..... 401/206; 401/264; 401/266

[58] Field of Search ..... 401/5, 205, 206, 401/261, 263–266, 267

[56] References Cited

U.S. PATENT DOCUMENTS

| | | | |
|---|---|---|---|
| 1,577,465 | 3/1926 | Houge | 401/263 |
| 1,964,512 | 6/1934 | Halpern | 401/261 |
| 2,888,695 | 6/1959 | Anderson et al. | 401/266 |
| 3,627,435 | 12/1971 | Hendershot | 401/265 |
| 5,727,893 | 3/1998 | Handler | 401/266 |
| 5,775,828 | 7/1998 | Ikeda | 401/266 |

FOREIGN PATENT DOCUMENTS

| | | | |
|---|---|---|---|
| 5-305529 | 5/1993 | Japan | 401/206 |
| 423546 | 3/1967 | Switzerland | 401/266 |
| 1161416 | 6/1985 | U.S.S.R. | 401/261 |
| 1227509 | 4/1986 | U.S.S.R. | 401/261 |
| 713642 | 8/1954 | United Kingdom | 401/266 |

*Primary Examiner*—Charles R. Eloshway
*Attorney, Agent, or Firm*—Rosenberg, Klein & Bilker

[57] ABSTRACT

A new pen nib structure for smooth painting, which has an outlet for discharging liquid fluently so as to paint different lines in one time, and more particularly to a type of correction pen. The main structure comprises a liquid container, a pen head, and a joint part, wherein a front end of the pen head is formed into a wedge nib with a round shape having a liquid discharging outlet provided at the middle part of the wedge nib; a valve rod supported by a spring has a front round nib end for extending out of the outlet. The nib structure is characterized in that two crescent slits are each provided beside said outlet respectively, and two guiding slits are provided on said wedge nib to be extended toward two opposite ends of said wedge nib. When using the pen, the wedge nib of the pen head is pushed against the paper so that the valve rod is pushed inward to open the valve. Since two crescent slits and two guiding slits are provided to enlarge the outlet, the liquid can flow out fluently for smooth painting.

3 Claims, 10 Drawing Sheets

PEN NIB STRUCTURE FOR SMOOTH PAINTING

FIELD OF THE INVENTION

The present invention relates to a new pen nib structure that can discharge the liquid fluently for smooth painting. The main structure comprises a pen head designed to be a wedge nib, and two crescent slits are each provided on one of the wedge faces beside a pen outlet respectively, and a guiding slit is provided on said wedge nib to be extended toward two opposite ends of said wedge nib, so that the liquid can flow out fluently for smooth painting.

BACKGROUND OF THE INVENTION

A conventional pen for painting, such as a correction pen, comprises generally a round nib to be catched at the front end of a tube. The slim gap between the nib and the tube is used for discharging the liquid, so the discharging quantity is limited. Furthermore, since the contact between the pen nib and the paper is just a point, it has to smear back and forth with the pen for correction. Sometimes the thickness of the liquid remained on the paper is not uniform, so the paper can not be fed into a facsimile machine or the liqiuid residues are rubbed to be remained in the machine to cause problems.

OBJECT OF THE INVENTION

It is therefore an object of the present invention to provide a new pen nib structure that can discharge the liquid fluently for smooth painting, so that the user can paint or correct uniformly the object in one time.

BRIEF DESCRIPTION OF THE DRAWINGS

The present invention can be better understood by detailed descriptions of the following drawings, in which.

DETAILED DESCRIPTION OF THE INVENTION

Figure 1A:
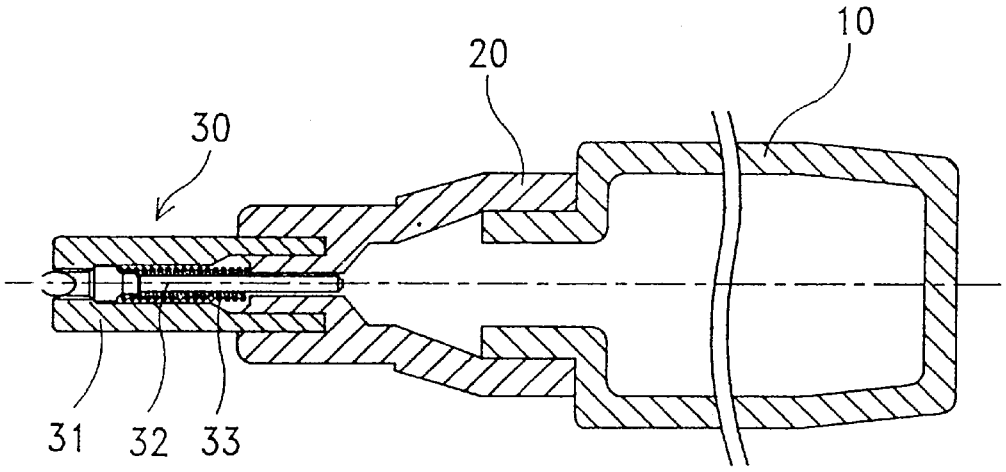
FIG. 1A is a longitudinal section view of a preferred embodiment according to the present invention.
Figure 1B:
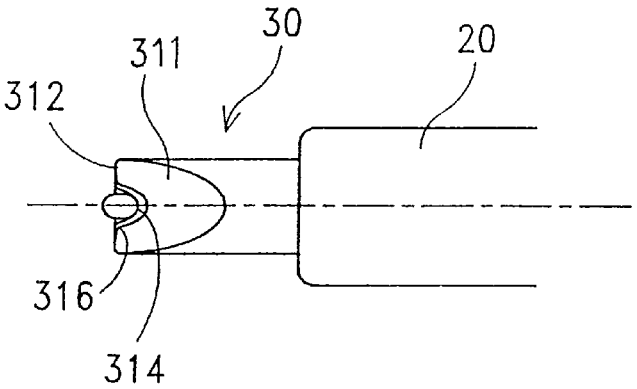
FIG. 1B is a front view of the preferred embodiment according to the present invention.
Figure 1C:
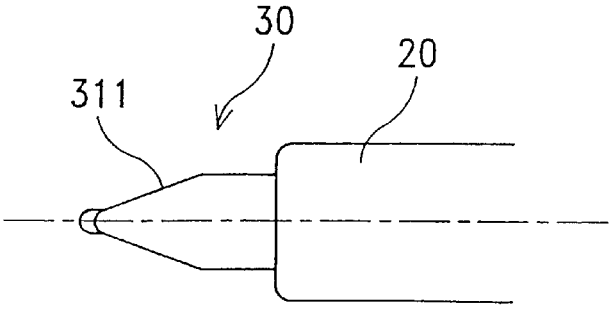
FIG. 1C is a side view of the preferred embodiment according to the present invention.
Figure 1D:
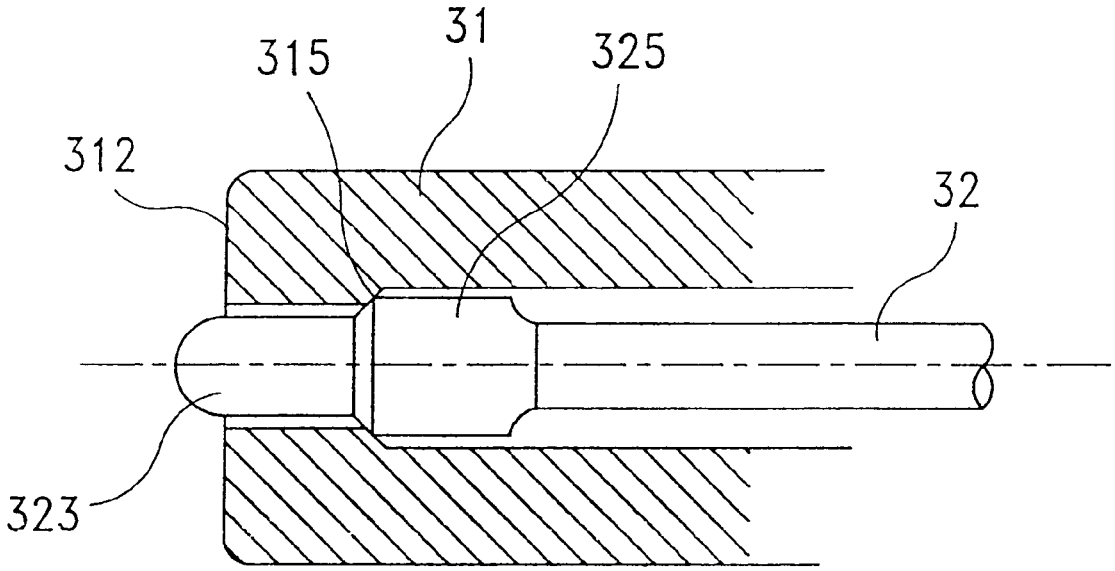
FIG. 1D is a partly enlarged view of the preferred embodiment according to the present invention.

Referring to FIGS. 1A~1D and FIG. 2, which show a preferred embodiment of the present invention. As shown in the figures, the pen of the present invention comprises a liquid container 10, a pen head 30, and a joint part 20. The pen head 30 includes a tube 31, a valve rod 32, and a spring 33. The back end of the tube 31 is opened to be inserted into the joint part 20 for accepting the liquid from the container 10. The front end of the tube 31 comprises two opposite faces 311 to be formed into a wedge shape. The wedge nib 312 is formed into a round shape having a liquid discharging outlet 313 provided at the middle part thereof. Two crescent slits 314 are each provided on one of the opposite faces 311 beside the outlet 313 respectively, having a guiding slit 316 (see FIG. 2) on each side to be extended toward two opposite ends of the wedge nib 312. The valve rod 32 is supported by the spring 33. The middle part 325 of the valve rod 32 is bigger than other parts, and abuts against an annular shoulder 315 provided within the tube 31 to form a valve. The front end of the valve rod 32 is a round nib rod 323 extending outward of the outlet 313. When using the pen, the wedge nib 312 of the pen head 30 is pushed against the paper so that the valve rod 32 is pushed inward to open the valve. Since two crescent slits 314 and two guiding slits 316 are provided to enlarge the outlet, the liquid can flow out fluently for smooth painting.

Figure 2:
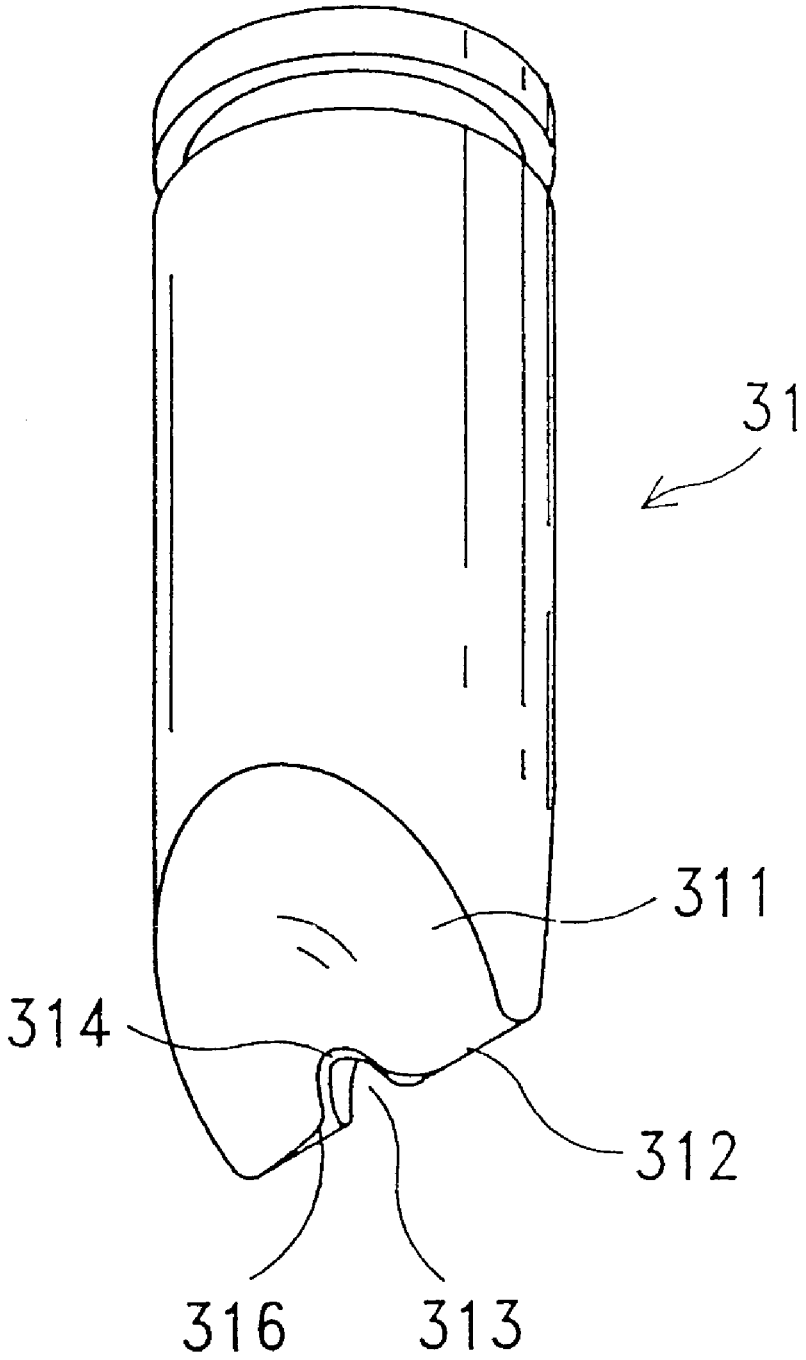
FIG. 2 is a perspective view of a pen head tube of the preferred embodiment according to the present invention.
Figure 3A:
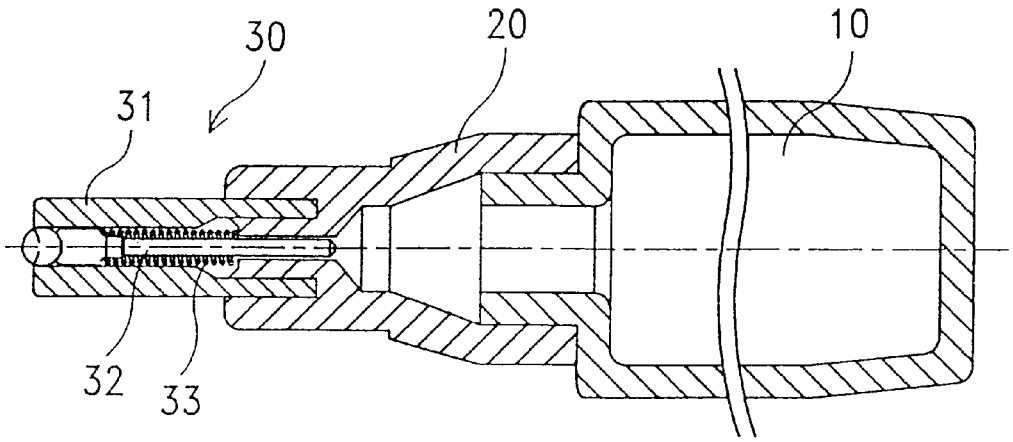
FIG. 3A is a longitudinal section view of a second embodiment according to the present invention.
Figure 3B:
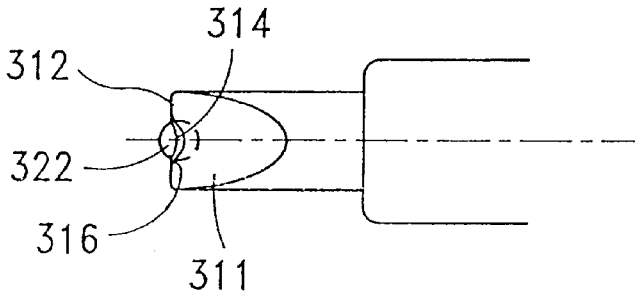
FIG. 3B is a front view of the second embodiment according to the present invention.
Figure 3C:
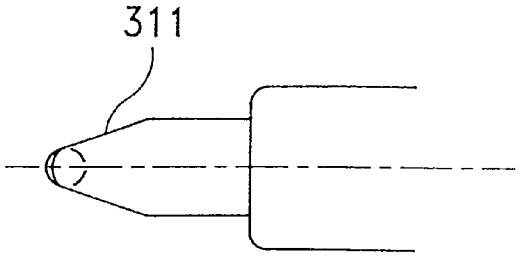
FIG. 3C is a side view of the second embodiment according to the present invention.
Figure 3D:
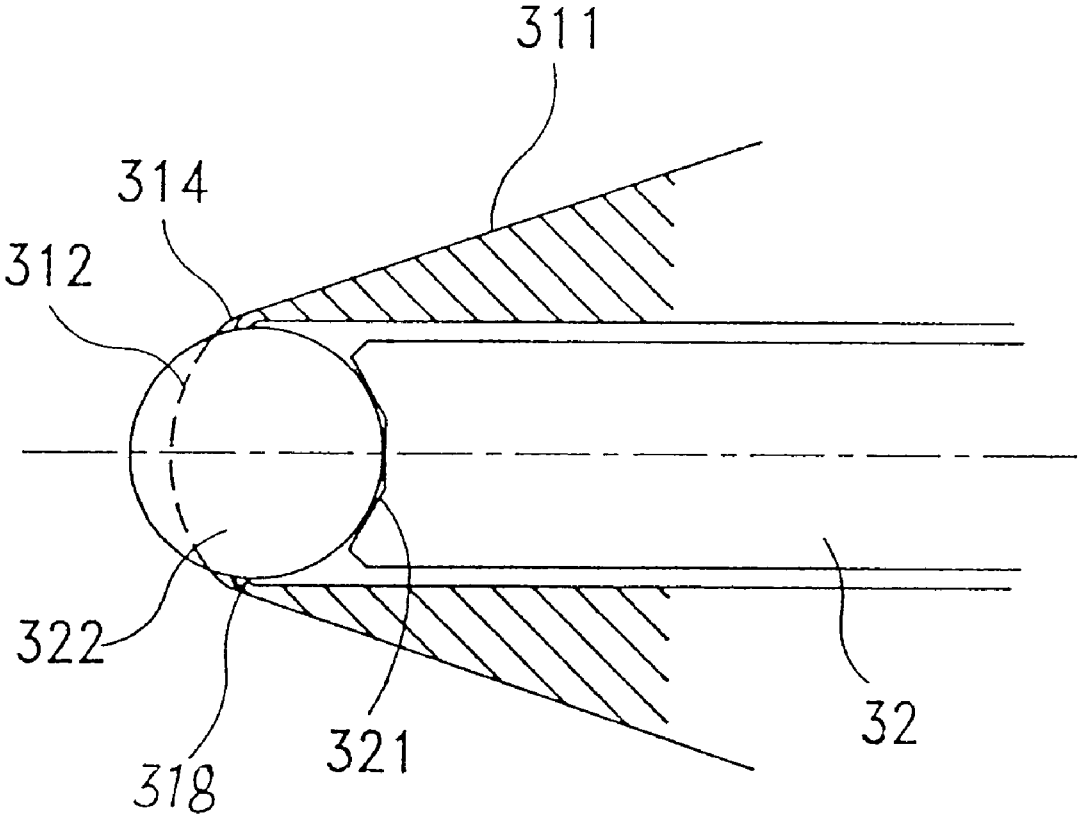
FIG. 3D is a partly enlarged view of the second embodiment according to the present invention.
Figure 4A:
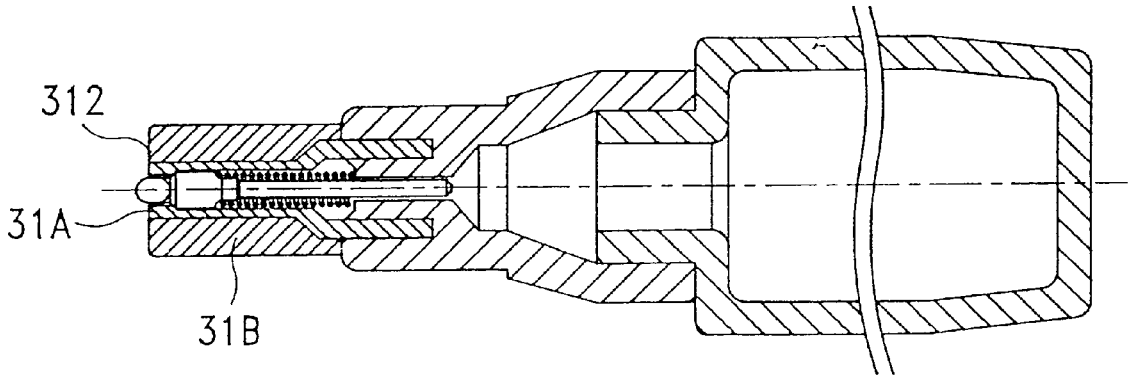
FIG. 4A is a longitudinal section view of a third embodiment according to the present invention.
Figure 4B:
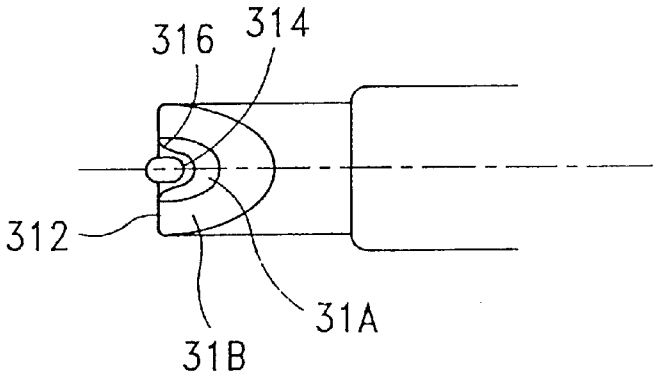
FIG. 4B is a front view of the third embodiment according to the present invention.
Figure 4C:
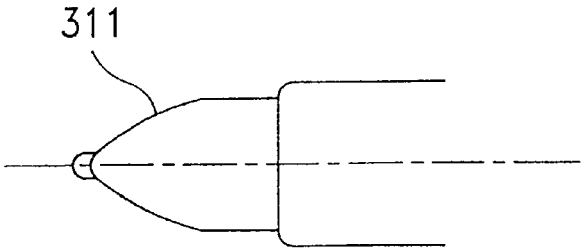
FIG. 4C is a side view of the third embodiment according to the present invention.
Figure 4D:
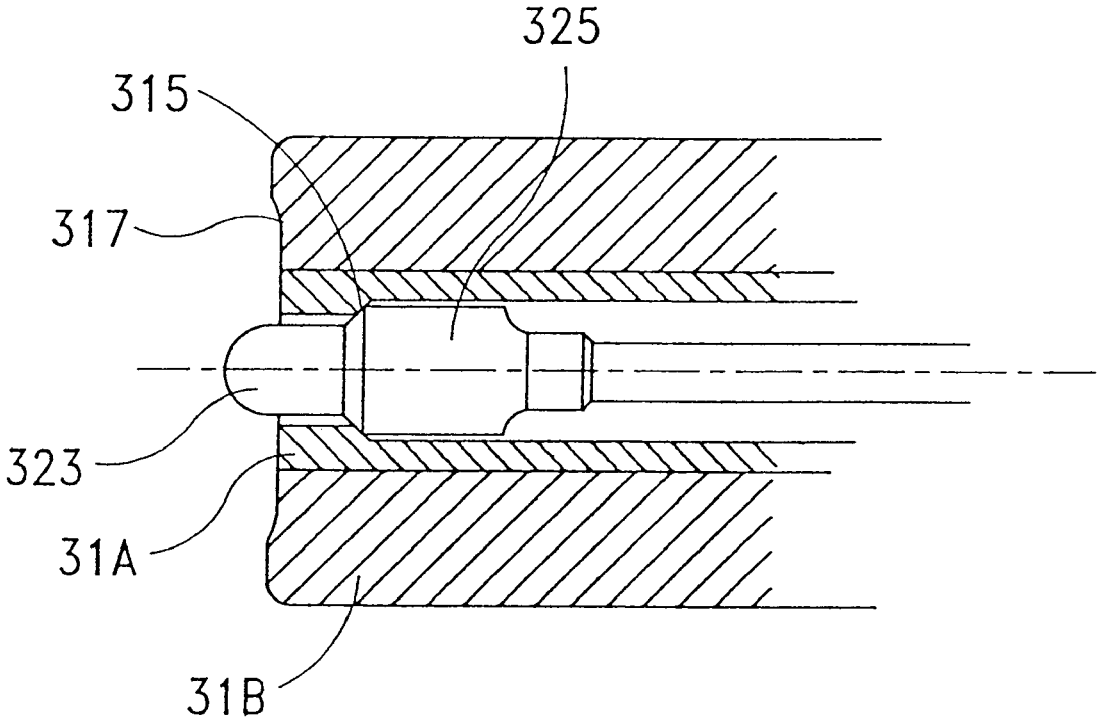
FIG. 4D is a partly enlarged view of the third embodiment according to the present invention.

Referring to FIGS. 3A~3D, which are schematic diagrams of a second embodiment according to the present invention. As shown in the figures, the pen of the second embodiment still comprises a liquid container 10, a pen head 30, and a joint part 20. The front end of the pen head 30 still comprises two opposite faces 311 to be formed into a wedge nib 312 having two crescent slits 314 as shown. However, the front end of the valve rod 32 is formed into a semi-circular recess 321 for abutting against a steel ball 322, and the liquid discharging outlet 313 shown in FIG.2 is designed to be a contracted outlet 318 for holding the steel ball 322 to form a valve.

Referring to FIGS. 4A~4D, which are schematic diagrams of a third embodiment according to the present invention. As shown in the figures, the tube 31 is formed by an inner tube 31A and a sleeve tube 31B. The sleeve tube 31B can be made of a soft material different from that of the inner tube 31A to make the painting more comfortable and can be replaceable.

Figures 5A, 5B:
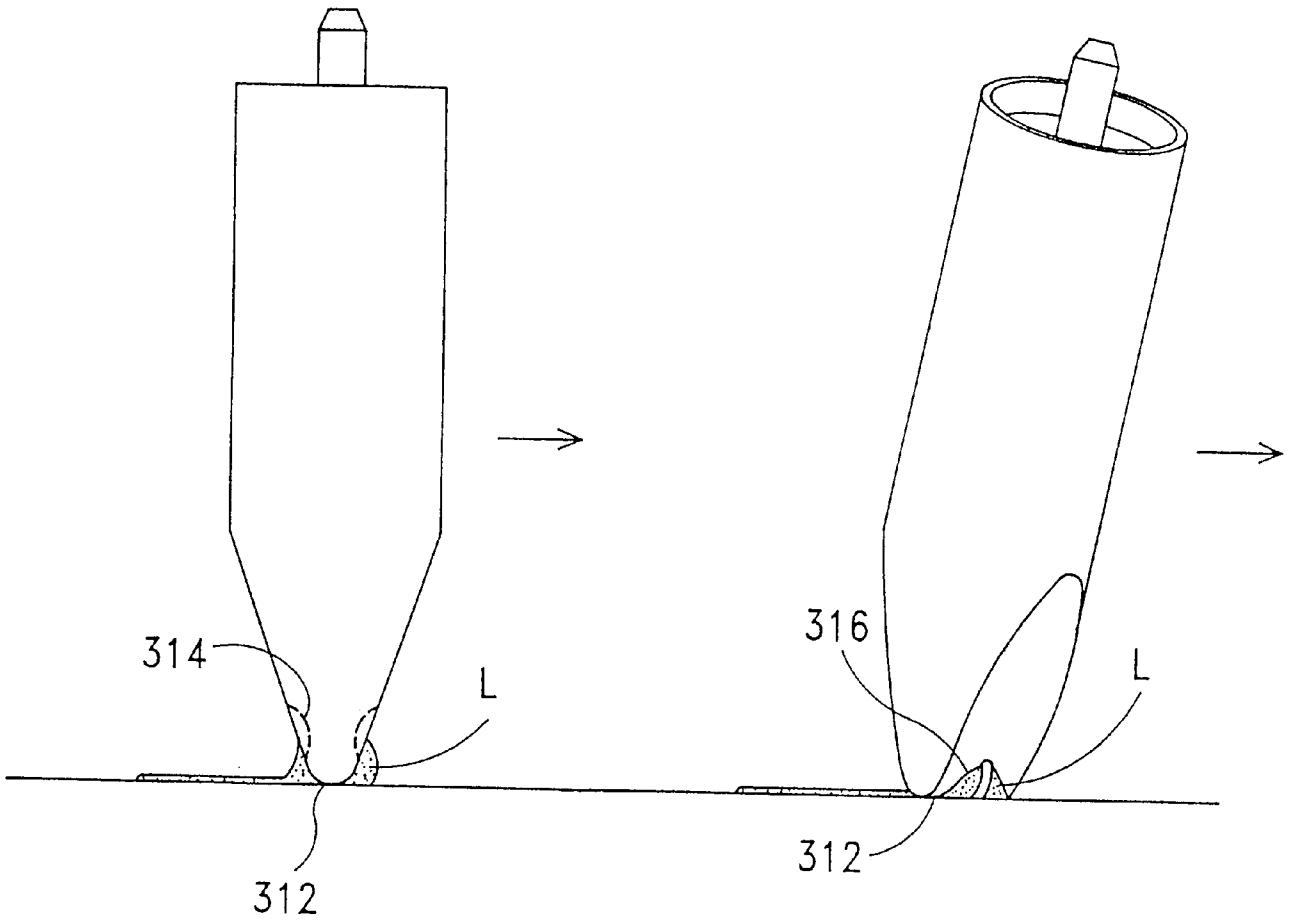
FIGS. 5A and 5B are schematic diagrams showing the smooth painting of the pen according to the present invention.

Referring to FIGS. 5A and 5B, which are schematic diagrams showing the smooth painting of the pen according to the present invention. As shown in the figures, the liquid "L" flows out of the outlet 313, the crescent slits 314 and the guiding slits 316 for smooth painting.

Figure 6A:
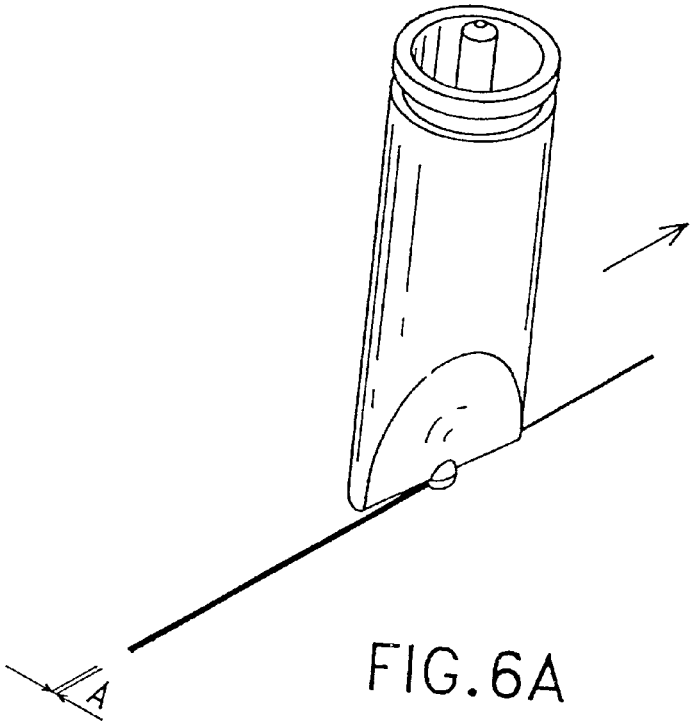
FIGS. 6A and 6B are schematic diagrams showing the painting of a slim line and a wide line with the pen according to the present invention.
Figure 6B:
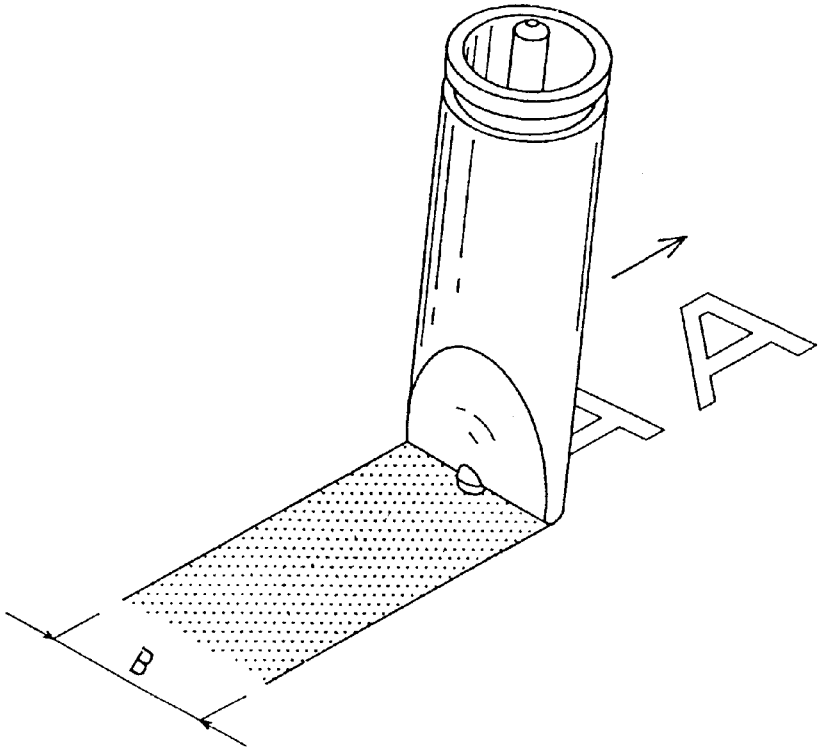

Referring to FIGS. 6A and 6B, which are schematic diagrams showing the painting of a slim line and a wide line with the pen according to the present invention. As shown in the figures, if a slim line is needed, the wedge nib 312 is aligned in parallel with the line to be painted, otherwise the wedge nib is arranged to be perpendicular to the line for a wider painting.

Figure 7:
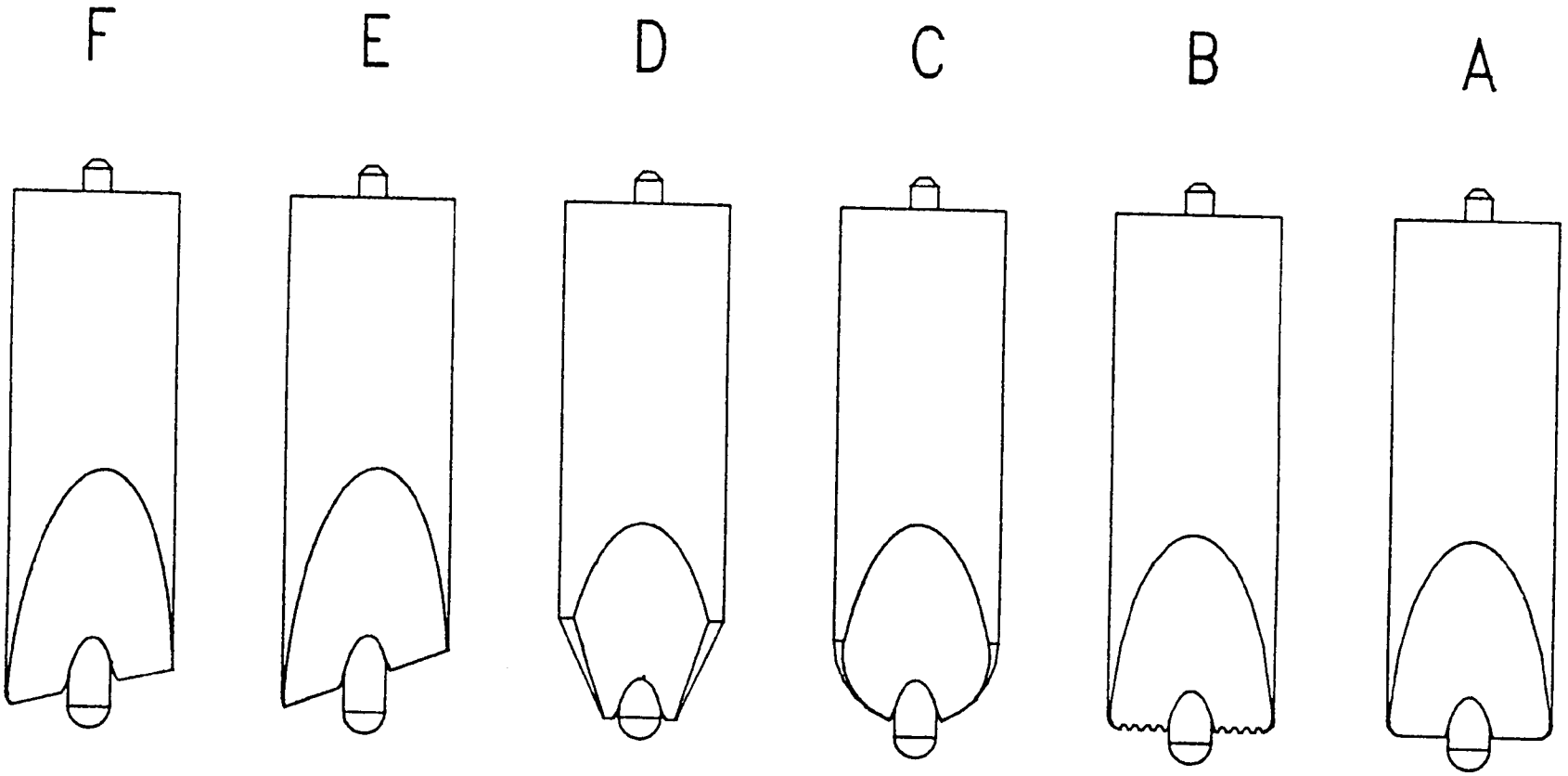
FIG. 7 shows that the pen head of the present invention can be designed into different shapes for different usage.

Finally referring to FIG. 7, the wedge nib 312 can be designed into different types for different usages, wherein "A" is a normal type, "B" is a corrugated type, "C" is a semi-circular type, "D" is a short edge type, "E" is a slant type having a steep slope, while "F" is a slant type having a mild slope. It is no doubt that after reading the above descriptions any skillful person in the art can create many different variations without departing the spirit and scope of the appended claims. Therefore, it is intended that the appended claims will cover all those variations.

We claim:

1. A new pen nib structure for smooth painting, comprising:

a liquid container;

a pen head including a tube, a valve rod, and a spring, said spring being used for supporting said valve rod, wherein a front end of said tube being formed into a wedge nib with a round shape having a liquid discharging outlet provided at a middle part of said wedge nib; said outlet extending inward into said tube to form an annular shoulder and expanding to be an inner bore of said tube; a round nib rod being provided at a front end of said valve rod for extending out of said outlet; a middle part of said valve rod being bigger than other parts thereof, and abutting against said annular shoulder to form a valve; two crescent slits each being provided beside said outlet respectively and adjacent said nib rod, and two guiding slits being provided on said wedge nib, each extending from a respective one of said crescent slits toward two opposite ends of said wedge nib; and, a joint part for connecting said pen head with said container.

2. A new pen nib structure for smooth painting according to claim 1, wherein said tube is formed by an inner tube and a sleeve tube.

3. A new pen nib structure for smooth painting according to claim 2, wherein said sleeve tube is made of a soft material different from that of said inner tube to make a painting more comfortable, and said sleeve tube being replaceable.

* * * * *